US010099259B2

(12) United States Patent
Anup et al.

(10) Patent No.: US 10,099,259 B2
(45) Date of Patent: Oct. 16, 2018

(54) INTELLIGENT GRADING MACHINE WITH TRAJECTORY TRACKING SENSOR NETWORK AND A PROCESS THEREOF

(71) Applicant: NANOPIX INTEGRATED SOFTWARE SOLUTIONS PRIVATE LIMITED, Hubli Dharwad, Karnataka (IN)

(72) Inventors: Vijapur Anup, Karnataka (IN); Krishnamoorthy Sasisekar, Karnataka (IN)

(73) Assignee: NANOPIX INTEGRATED SOFTWARE SOLUTIONS PRIVATE LIMITED, Hubli, Karnataka (IN)

( * ) Notice: Subject to any disclaimer, the term of this patent is extended or adjusted under 35 U.S.C. 154(b) by 0 days.

(21) Appl. No.: 15/558,333

(22) PCT Filed: Mar. 16, 2016

(86) PCT No.: PCT/IN2016/000068
§ 371 (c)(1),
(2) Date: Sep. 14, 2017

(87) PCT Pub. No.: WO2016/147203
PCT Pub. Date: Sep. 22, 2016

(65) Prior Publication Data

US 2018/0065157 A1 Mar. 8, 2018

(30) Foreign Application Priority Data

Mar. 16, 2015 (IN) ..... 1291/CHE/2015

(51) Int. Cl.
*B07C 5/36* (2006.01)
*B07C 5/10* (2006.01)
(Continued)

(52) U.S. Cl.
CPC ..... *B07C 5/366* (2013.01); *B07C 5/10* (2013.01); *B07C 5/342* (2013.01); *B07C 5/362* (2013.01);
(Continued)

(58) Field of Classification Search
CPC ..... B07C 5/342; B07C 5/3425; B07C 5/361; B07C 5/362; B07C 5/363; B07C 5/366;
(Continued)

(56) References Cited

U.S. PATENT DOCUMENTS 3,650,397 A 3/1972 Bornemeier
3,773,172 A 11/1973 McClure et al.
(Continued)

FOREIGN PATENT DOCUMENTS

WO WO-2016000967 A1 1/2016

*Primary Examiner* — Joseph C Rodriguez
(74) *Attorney, Agent, or Firm* — Harness, Dickey & Pierce, P.L.C.

(57) ABSTRACT

The present invention discloses a multi-channeled grading machine with trajectory tracking sensor network for grading objects into multiple grades in a single pass based on external characteristics viz. size, shape, color, texture, surface properties or any other possible external characteristics by continuously tracking the trajectory of objects. The grading machine comprises of hopper; at least one feeding unit; multiple optics units multiple conduits; multiple sensor networks in multiple conduits; at least one master controller; at least one ejector unit comprising of arrays of single-angled or multiple angle ejectors in each conduit; multiple vacuum creators placed respectively opposite to each ejector; multiple collecting chutes; and multiple collecting locations. The grading machine is extremely simple, accurate, and automated, power-efficient and cost-effective.

9 Claims, 6 Drawing Sheets

(51) Int. Cl.
*B07C 5/342* (2006.01)
*B07C 5/38* (2006.01)

(52) U.S. Cl.
CPC ..... *B07C 5/38* (2013.01); *B07C 2501/009* (2013.01); *B07C 2501/0018* (2013.01); *B07C 2501/0081* (2013.01)

(58) Field of Classification Search
CPC ..... B07C 5/367; B07C 5/368; B07C 5/38; B07C 5/10; B07C 5/12; B07C 5/126; B07C 2501/0018; B07C 2501/0081
See application file for complete search history.

(56) References Cited

U.S. PATENT DOCUMENTS 4,513,868 A 4/1985 Culling et al.
4,663,522 A * 5/1987 Welbourn ..... B07C 5/3425 250/223 R
4,718,558 A * 1/1988 Castaneda ..... B07C 5/3425 209/546
4,799,596 A * 1/1989 Mallant ..... B07C 5/342 209/580
4,863,041 A * 9/1989 Bailey ..... B07C 5/342 209/580
4,878,582 A * 11/1989 Codding ..... B07C 5/3425 209/580
4,940,850 A * 7/1990 Satake ..... B07C 5/3416 209/580
5,012,116 A * 4/1991 Russell ..... G01N 21/951 250/559.16
5,751,833 A * 5/1998 Blit ..... B07C 5/3422 209/576
5,791,489 A 8/1998 Leifeld
6,031,931 A * 2/2000 Chiu ..... G06T 7/13 382/141
6,814,211 B2 11/2004 Yunker et al.
7,905,357 B2 3/2011 Svatek et al.
7,968,814 B2 * 6/2011 Imai ..... B07C 5/3425 209/576
8,247,724 B2 8/2012 Mills et al.
8,937,282 B2 * 1/2015 Owen ..... G01N 23/2252 250/306
9,316,537 B2 * 4/2016 Bamber ..... G01J 3/00
2003/0201211 A1 10/2003 Bennett et al.
2003/0221935 A1 12/2003 Barklin et al.
2006/0219612 A1 10/2006 Oestreich et al.
2010/0096300 A1 4/2010 Mills et al.
2018/0071788 A1 * 3/2018 Anup ..... B07C 5/342

* cited by examiner n* denotes a natural positive integer

INTELLIGENT GRADING MACHINE WITH TRAJECTORY TRACKING SENSOR NETWORK AND A PROCESS THEREOF

FIELD OF THE INVENTION

The present invention relates generally, to grading machines and grading processes for grading objects of different properties. More particularly, it relates to a novel intelligent grading machine with trajectory tracking sensor network for grading objects and a novel process for grading objects into multiple grades in a single pass by continuously tracking the trajectory of objects with sensor network.

BACKGROUND OF THE INVENTION

The need to be responsive to market demand requires a greater emphasis on quality assessment resulting in the greatest need for grading of any agricultural produce as it procures high price to the grower and improves packaging, handling and brings an overall improvement in the marketing system. Today, the grading process has been fully mechanized. A mechanical grader consists of a chain conveyor belt, with a bag at the end along with fewer or more modifications like use of color sensors or use of image processing systems, etc. In grading machine, the grading machine grades smaller or bigger produce fall through the chain, making the grading process easier. Conventionally, the sorting machines provide a binary output. The objects are dumped from the hopper and they are made to slide on a set of channels. They present themselves to the cameras during the fall and the cameras decide upon the defects and if found any, then they actuate the ejectors and a high jet of air is passed for a short period of time making the desired object to fall into the collecting bin, thereby grading objects. During this process, when the object once made to fall and pass the camera, the accurate position of the object is not known so it becomes tedious to know the position of the object in real time and eject them into different grades based on their different properties. The conventional sorting machine need multi passes to get multiple distinguishable grades.

Few patent documents which describe sorting or grading of different objects as described hereinafter. U.S. Pat. No. 3,650,397 titled "system for inspecting and classifying objects such as screws, bolts and the like while in motion" discloses a system for sorting threaded objects such as screws, bolts comprising sequential detection. Disadvantage of the system can be observed as it sorts only the threaded objects and sorting is binary. The system further does not claim anything on the positioning of objects in the free fall. U.S. Pat. No. 3,773,172 titled "blueberry sorter" discloses an automatic sorting apparatus for object with an ejection system comprising a plurality of air nozzles disposed adjacent the carrier or input conveyor means and connected through high pressure air valves to a source of pressurized air. A logic network interprets the signals from the electronic system to cause selected air valves to be actuated at particular times so that air blasts, then pass through the apertures in the fruit laden cups to eject the fruit from the input conveyor means at different sorting stations onto output conveyors in accordance with the sensed condition of the fruit. The disclosed sorting machine is complex in arrangement and it is mainly designed to sort blueberries and other fruits such as apples, oranges, cranberries, grapes, cherries, and any other fruit or vegetables which have an approximately spherical shape, thereby limiting the scope of sorting by excluding other objects which are not fruits or vegetables. U.S. Pat. No. 6,814,211 titled "slide for sorting machine" discloses a slide for gravity sorting of objects. It uses a sensor to interpret the position of objects and according to its delay time uses an ejector to eject the object into a bin. The machine uses a delay time for ejection which may change due to different factors as it is an open loop system which leads to inaccuracy and inefficiency of the system while sorting objects. U.S. Pat. No. 7,905,357 titled "product flow control apparatus for sorting" discloses a feed control apparatus for use in a gravity slide sorter for sorting of products comprising an ejector system for sorting small objects such as almonds, peanuts and rice grains or other food or fungible materials. It eliminates particulate matter by detecting and ejecting objects falling from slant surface. A major disadvantage of the system is that it sorts the objects in acceptable and unacceptable (binary) items only. U.S. Pat. Application No. 20100096300 titled "chutes for sorting and inspection apparatus" discloses different sections of slant surfaces to gravity sort the objects in acceptable and unacceptable items. One of the disadvantages of the apparatus may be seen as the product pieces may get stuck due to alignments in slant sections, which will affect its accuracy. Another disadvantage is that the device sorts the objects in a binary fashion as acceptable and unacceptable classes only.

PCT Publication No. WO2016000967 titled "Transport apparatus with vacuum belt" discloses a system for sorting particles like grains, seed in three quality classes. It uses a vacuum belt to carry the particles from hopper at the lower end to the fixed camera at the upper end. A significant loophole of the system is blockage of the perforations on the vacuum belt due to foreign particles often associated with grain or seed, thereby decreasing its efficiency. Moreover, though the system sorts the particles in three quality classes, there is still tremendous scope ahead to explore in this area to provide multiple quality classes rather than only two or three classes or grades.

Typical sorting or grading systems that are known in practice, often less efficient due to limitation in the number of classes or grades that the machine provides and the lack of co-ordination in between tracking of accurate position of moving object and the actuation of ejectors to blast that object of particular characteristics to get quality grade without missing a single quality grade.

Therefore, there creates a strong need to solve above mentioned problems by providing a novel grading machine which is simple, more efficient, more accurate and cost-effective grading machine to grade different types of objects into multiple commercial grades in a single pass by continuously tracking their trajectory. It would also be desirable to provide a novel process for grading such objects into multiple commercial grades in an easy, simple and time-efficient manner.

SUMMARY OF THE INVENTION

Present invention recognizes and addresses various disadvantages and drawbacks of the existing sorting and grading machine and grading process and provides a novel grading machine and related novel process for grading variety of objects into multiple grades accurately to increase efficiency of grading process tremendously, thereby saving significant amount of time and labor.

In accordance with one aspect of the present invention, the invention discloses a novel intelligent and multi-channeled grading machine with trajectory tracking sensor network for grading objects based on external or physical characteristics into multiple grades in a single pass by continuously tracking the trajectory of objects. The novel grading machine comprises of at least one hopper; at least one feeding unit comprising of multiple feeder and multiple feed controllers; multiple optics units, wherein each optics unit comprises multiple cameras and multiple light source; multiple conduits; multiple sensor networks, wherein a single sensor network is assigned for single conduit and it comprises of multiple sensor layers arranged throughout single conduit, multiple sensor layer controllers and at least one network controller for controlling all sensor layer controllers of a single conduit; a single ejector unit comprising of arrays of single-angled or arrays of multiple angled ejectors in each conduit; at least one master controller to coordinate different signals from multiple optics units, multiple network controllers of the grading machine and to provide final directions for ejection of different objects from multiple conduits to provide multiple grades in a single pass; multiple collecting chutes to convey graded objects for further collection; and multiple collecting locations to collect multiple grades. The machine further comprises of multiple vacuum creators placed respectively opposite to each said ejector throughout each conduit for easy grading.

Accordingly, the main object of the present invention is to provide a novel, extremely simple, accurate, intelligent, automated and multi-channeled grading machine for grading objects into multiple grades in a single pass based on external characteristics by continuously tracking the trajectory of each object using sensor network and triggers corresponding ejectors with clear knowledge of where the accurate position of object is in corresponding conduit, which makes the machine unique. The grading machine also uses multiple cameras which capture at least six directional view of each object in coordination with light sources for enhanced analysis of each object, so the grade possibilities are immense which enables the grading machine to grade 'n' number of grades intelligently using master controller based on different external properties. The grading machine grades, multiple grades in a single pass so that it eliminates the room for multi-pass to get efficient grade which is the case in the conventional inventions and moreover, the grading machine grades 'n' number of grades in a single pass unlike the conventional two grades (binary) sorting.

Further, the grading machine which comprises of a specialized ejector unit comprising of arrays of multiple ejectors in each conduit which are located as a group of multiple single-angled or multiple multi-angled ejectors at each grade throughout each conduit of the grading machine, wherein a separate single-angled or multi-angled ejectors are placed for each grade, which are responsive to signals from the master controller for expelling a predefined duration blast of high pressure fluid or high pressure air towards the direction of object by targeting accurate position, velocity etc. of the conveying object, thereby ejecting the conveying object into corresponding collecting location, and further the machine also comprises vacuum creators placed respectively opposite to each said ejector throughout the conduit for easy and effective grading. The grading machine has minimal moving parts which makes the machine power-efficient and cost-effective.

In accordance with another aspect of the present invention, the invention discloses a novel process for grading objects into multiple grades in a single pass based on various external or physical characteristics viz. size, shape, color, surface properties, or any other characteristics by continuously tracking their trajectory with sensor network for accurate ejection of each grade of object from corresponding conduit into multiple grades. The novel grading process grades any kind/variety/type of object efficiently without limiting the nature of object to be graded, thereby broadens the scope of grading operation for variety of objects without restricting its scope for grading limited types of objects like agricultural produce etc.

BRIEF DESCRIPTION OF THE DRAWINGS

Other objects, features and advantages of the invention will best be understood from the following description of various embodiments thereof when read with reference to accompanying drawings and the accompanying drawings are only exemplary drawings for the purposes of illustration.

DETAILED DESCRIPTION OF THE INVENTION

Figure 1:
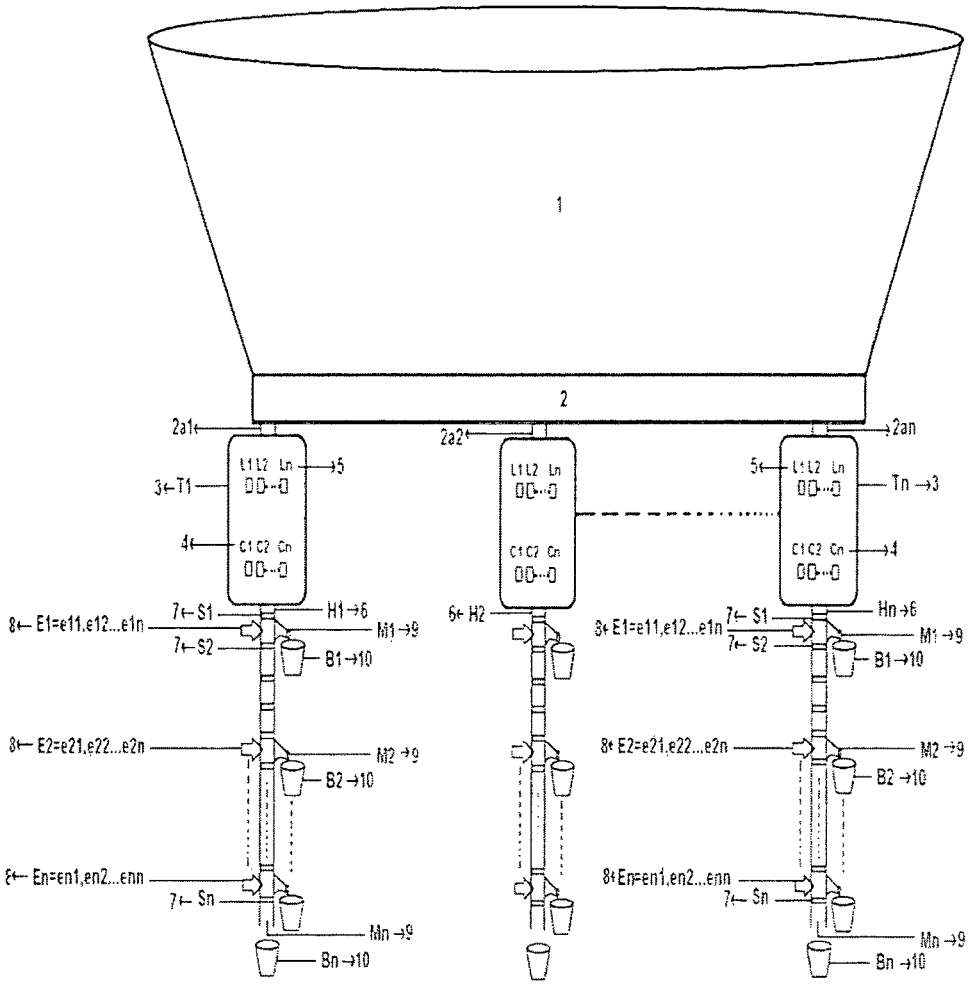
FIG. 1 is a front schematic view of a novel, intelligent grading machine for grading objects of different external characteristics according to one embodiment of the invention.

The present invention will now be described in a great detailed manner with reference to the accompanying exemplary drawings for the purposes of illustrating non-limiting embodiments of the present invention.

As used herein, the term 'object' shall refer to any regular, irregular, even, uneven, homogeneous, non-homogeneous material which includes any naturally occurring product including but not limited to any agricultural product like cashews, almonds, raisins, cloves, walnut, pistachios, or can be all culinary nuts, dry fruits and other regularly or irregularly shaped objects like diced vegetables and the term 'object' also includes synthetically manufactured material including but not limited to plastic pellets, artificial stones, gems etc.

As used herein, the term 'homogeneous' shall refer to any one type of object like only almonds to be graded or only cashews to be graded or only artificial stones to be graded.

As used herein the term 'non-homogeneous' shall refer to mixture of different types of objects like a mixture of cashews and almonds or a mixture of plastic pellets and any one, two or more type of objects, wherein the term 'non-homogeneous' shall refer to any possible combination or variations of mixture of objects.

As used herein, the 'size' of object to be graded in the grading machine is an average size ranged in between 2 mm to 35 mm measured at the extreme ends of the object.

As used herein, the term 'external' or 'physical' characteristics shall refer to any characteristics including but not limited to size, shape, color, texture, surface properties, or any other possible external or physical characteristics.

As used herein, there are multiple optics units in the grading machine of the present invention as at least one optics unit is attributed to at least one conduit, wherein each optics unit comprises of 'multiple cameras' and 'multiple light sources', wherein the light sources are specific light sources to ensure the enhanced surface analysis of the objects. The term 'multiple cameras' refer to 'multiple programmable cameras' which are programmable cameras for the purposes of the invention. These cameras can be 'regular color cameras' or 'multi-spectral cameras' and further these 'multiple cameras' can be synchronous or asynchronous or both. The term 'multi-spectral cameras' work at different frequencies of electromagnetic spectrum (multi-spectrum) like visible, ultra-violet, infra-red (IR), x-ray etc. for analysis of the objects spectral properties. As used herein, the term 'conduit' may be a vertical tube with 'gravity as conveyance' or 'a slant surface' or 'a horizontal surface' or 'conveying opposite to gravity' and each 'conduit' comprises of multiple sensor layers. The 'conduit' may be arranged in any direction, thereby enabling multiple sensor layers to track the trajectory of each object continuously. Multiple sensor layers are used to determine the position, velocity etc. of the object on instantaneous bases and provide the related information in real time.

As used herein, the term ejector unit in the grading machine of the present invention comprises of arrays of multiple ejectors in each conduit. Each ejector is a group of multiple single-angled ejectors or multiple multi-angled (multiple angle-based) ejectors and the term 'ejector' may refer to 'single-angled ejector' or 'multi-angled ejector' or both.

As used herein, 'pressure of fluid' or 'pressure of air' may differ according to different 'external' or 'physical' characteristics of the objects.

According to one embodiment of the present invention, referring to FIG. 1, it is a side schematic view of a novel intelligent and multi-channeled grading machine for grading objects of different external or physical characteristics. The disclosed invention describes a novel intelligent and multi-channeled grading machine with trajectory tracking sensor network for grading objects into multiple grades in a single pass based on external characteristics viz. size, shape, color, texture, surface properties or any other possible external or physical characteristics by continuously tracking the trajectory of objects. The non-limiting elements of the grading machine comprises of at least one hopper (1); at least one feeding unit (2) comprising of multiple feeder and multiple feed controllers; multiple optics units (3), wherein each optics unit comprises of multiple cameras (4), and multiple light source (5); multiple conduits (6); multiple sensor networks (7) in multiple conduits, wherein each conduit comprises of a single sensor network; at least one master controller; at least one ejector unit comprising of arrays of single-angled or multiple angle ejectors (8) in each conduit (6); multiple collecting chutes (9); and multiple collecting locations (10). The machine further comprises of multiple vacuum creators (Not shown in FIG. 1) placed respectively opposite to each ejector (8) throughout each conduit (6) for easy grading.

The grading machine has huge hopper (1) into which objects having different external characteristics are fed. The hopper (1) acts as a reservoir and as a distribution unit to continuously distribute or flow objects into the feeding unit (2). The objects flow from the hopper (1) into the feeding unit (2) which is located below hopper (1) to receive objects, wherein the feeding unit (2) comprises of multiple feeder shown as 2*a*1, 2*a*2, . . . 2*an* and multiple feed controllers (Not shown in FIG. 1) and at least one feeder (2*a*1 or 2*a*2 or 2*an*) is connected at lower side to at least one optics unit (3), thereby the grading machine is divided into multiple channels downwards from common feeding unit (2). The objects are released from multiple feeders (2*a*1, 2*a*2, . . . 2*an*) of the feeding unit (2) into multiple optics units shown as T1, T2, . . . Tn (3) which are connected to the corresponding multiple feeders (2*a*, 2*a*2, . . . 2*an*) at their top, and lower side of multiple optics units (3) are connected further to the corresponding multiple conduits (6), wherein at least one optics unit (3) is placed at the top of starting point of each conduit (6). There is at least one feed controller for one feeder to control bulk flow of objects from corresponding feeder into corresponding optics unit (3) and further into corresponding conduit (6) for effective feeding, thereby making the feeding unit (2) as completely automated and controlled based on the need of number of objects to be fallen in particular conduit. Feed controller of corresponding feeder receives signals related to flow of objects from network controller of sensor network of corresponding conduit through master controller as the feed controller of corresponding conduit is coupled with the master controller for effective feeding of objects from corresponding feeder into corresponding optics unit and further into corresponding conduit (6).

Objects flow from the multiple feeders (2*a*. 2*a*2, . . . 2*an*) of the feeding unit (2) into multiple corresponding optics units (3). Each optics unit (3) comprises of multiple programmable cameras (4) shown as C1, C2, . . . Cn, and multiple light sources (5) shown as L1, L2, . . . Ln. Once object enters into any optics unit (3), cameras (4) of corresponding optics unit (3) view each object from multiple sides or multiple angles and capture at least six directional view of each object to analyze each object three dimensionally (3D) using correlation between multiple cameras which gives the information about different external characteristics of each object. Multiple light sources (5) of the optics unit (3) finds/enhances features of each object by illuminating each object which enable cameras (4) to analyze each object in a more enhanced manner. These cameras (4) along with light sources (5) analyze different external characteristics of each object passing through each optics unit. Cameras (4) of each optics unit (3) decide the exact grade of each analyzed object and processes the captured data, therefore the optics unit (3) can decide exact grades of each object. Each optics unit (3) communicate signals related to grade of each object to the master controller and the master controller further decides the exact, accurate, final grade of each analyzed object based on input signals provided by each optics unit (3). The master controller remembers intelligently the final grade of each object present in optics unit (3).

Objects further flow from multiple optics unit (3) into corresponding multiple conduits shown as H1, H2, . . . Hn (6) which are connected at their top to multiple optics units (3). The form and arrangement of conduit (6) can vary according to the need of the invention. The conduit (6) may be a vertical tube with gravity as conveyance or a slant surface or a horizontal surface or conveying opposite to gravity. In FIG. 1, the conduit (6) is shown as a tube with 'gravity as conveyance'. Each conduit (6) comprises of single sensor network and arrays of multiple ejectors (8) along with multiple vacuum creators, wherein at least one vacuum creator is arranged respectively opposite to each corresponding ejector throughout each conduit for predictable exit of the object into particular collecting grading location. Multiple sensor networks (7) are located in multiple corresponding conduits (6), wherein one sensor network is located in each conduit (6) and each sensor network comprises of multiple sensor layers which are shown as S1, S2 . . . Sn (7) which are lined up throughout each conduit (6), multiple sensor layer controllers to receive signals from corresponding multiple sensor layers (7) and at least one network controller for controlling all sensor layer controllers of corresponding conduit, wherein each sensor layer comprises of multiple sensors which continuously track the trajectory of objects in corresponding conduits (6). As objects are conveyed through each conduit (6), multiple sensor layers (7) which are lined up throughout each conduit (6) from the starting point of each conduit till the last dropping point (collecting locations) in such a way that it will continuously track the position of each object in its trajectory in real time and triggers signals to corresponding multiple sensor layer controller. These multiple sensor layer controllers (7) are located outside the corresponding conduit (6). There is a single sensor layer controller for controlling functioning of single sensor layer (7) located inside the corresponding conduit (6).

There are multiple sensor layer controllers to coordinate with corresponding multiple sensor layers (7). Multiple sensors of each sensor layer (7) of each conduit (6) continuously track the trajectory of conveying objects that particular conduit (6) to determine the position, velocity etc. of each object accurately in real time and trigger signals to corresponding sensor layer controller about the current position, velocity etc. of each conveying object in the corresponding conduit in real time. Each sensor layer controller receives signals from only one sensor layer (7), thereby determining the exact position, velocity etc. of each conveying object accurately in real time by interpreting information received from one sensor layer (7). Each sensor layer controller decides the time period required for each conveying object to convey in corresponding conduit to particular grading point. Each sensor layer (7) is connected to corresponding sensor layer controller and further each sensor layer controller is coupled to at least one network controller of corresponding conduit (6). Network controller of corresponding conduit receives information from all sensor layer controllers of corresponding conduit (6) and further sends signals to the master controller related to exact position, velocity etc. of each grade of conveying object accurately in real time, therefore these signals from all sensor layer controllers of each corresponding conduit (6) are communicated to the master controller through the network controller of each corresponding conduit as the object cuts the multiple rays of corresponding sensor layers, so that the master controller can decide, the exact position, velocity etc. of each grade of conveying object accurately in real time. If any sensor layer detects any hollow or damaged conveying object in corresponding conduit, then properties like specific gravity and hollowness of such any object can also be sensed intelligently by network controller of corresponding sensor network depending on velocity variation of any such object and signals same information to the master controller.

The master controller can decide the accurate position of grade of each such conveying object to reach to its grading point in real time. The information about position, velocity etc. of each conveying object is analyzed by all sensor layer controllers of corresponding conduit accurately in real time as all sensor layer controllers are always active during the grading process to receive signals from one or multiple sensor layers of corresponding conduit (6) to sense each grade which can randomly come across any sensor of corresponding conduit (6).

Further, the grading machine comprises at least one ejector unit and this ejector unit comprises arrays of multiple ejectors in each conduit of the grading machine. This ejector unit comprises of arrays of multiple ejectors (8) in each conduit (6) to eject each analyzed grade of objects. As shown in FIG. 1, multiple ejectors (8) are shown as E1, E2 . . . En, as there can be 'n' number of ejectors in each conduit (6), where n* is a natural positive integer. Each ejector (8) is a group of single-angled or multi-angled ejectors which are placed at same level as shown in FIG. 1, one such ejector (E1) is shown as a group of single-angled or multi-angled ejectors shown as e11, e12 . . . e1*n*. Second ejector (E2) is shown as e21, e22, . . . e2*n* and last ejector (En) is shown as en1, en2, . . . enn. Single-angled ejectors or multi-angled ejectors are used in the grading machine according to the property of the object like specific gravity, hollowness etc. to be graded as there is difference in speed of different sized objects while conveying at different corners of the conduit. Single angled or multi-angled ejectors are appropriately used as per requirement. These types of ejectors will be used for predictable ejection, hence making the system more efficient. The system may also consist of customized manifold for easy ejection of differently sized conveying objects.

Each ejector (8) is coupled to the master controller for receiving signals related to expelling a jet of a predefined duration of high pressure air or high pressure fluid towards the conveying object in corresponding conduit (6) as each ejector (8) receives signals related to ejection of each grade of object sent by the master controller before the arrival of each grade of object in corresponding conduit (6). The master controller decides the accurate final grade of each analyzed object based on signals received from the optics unit (3) related to external characteristics of objects. The master controller is capable of anticipating the exact position, velocity etc. of each object before the arrival of grading point during its trajectory in corresponding conduit based on signals received from each sensor layer controller through network controller of sensor network of corresponding conduit (6) related to the exact position, velocity etc. of each grade of object accurately in real time. Based on these aforementioned two different signals received by the master controller, the master controller sends signals to corresponding/particular single-angled ejectors (8) or multiple angled ejectors (8) of corresponding conduit related to ejection of said conveying objects, wherein these ejectors (8) are located at same level near each grading point in corresponding conduit (6) to expel a jet of pre-defined duration of high pressure air or high pressure fluid to eject the particular grade of object in corresponding collecting location (10). Responsive to said signals from the master controller, the moment the particular grade of object conveys near the grading point in corresponding conduit (6) wherein particular single-angled or multi-angled ejectors are located, it opens a valve to expel a jet of a pre-defined duration of high pressure air or high pressure fluid is directed towards the conveying object across its trajectory at particular position in corresponding conduit (6) and the pressure applied by said ejectors (8) eject each grade of object accurately and makes each grade of object to fall into the corresponding desired collecting location (10) shown as B1, B2 . . . Bn through corresponding multiple collecting chutes (9) shown as M1, M2, . . . Mn as there can be 'n' number of collecting chutes (9) and corresponding 'n' number of multiple collecting location (10) for collecting different grades of objects into multiple grades in a single pass. At each grading point, the grading machine has at least one ejector (S) which can be single-angled ejectors or multi-angled ejectors and at least one collecting chute along with corresponding collecting location is located. These single-angled or multi-angled ejectors are placed along the trajectory of the conveying object to facilitate yield to multiple grades of the objects in a single pass continuously with increased efficiency in the grades as well.

The grading machine further comprises of multiple vacuum creators (Not shown in FIG. 1) placed respectively opposite to each ejector (8) throughout each conduit (6) for easy grading. The generation of vacuum at each of the collecting chute (9) is based on the signals communicated by at least one sensor layer controller through network controller corresponding to particular conduit (6). The hopper, the feeding unit, the optics unit, the conduit or other parts of the grading machine are made from materials like polyurethane, food grade acrylic, ionized elements or teflon coated material etc. The conduit (6) can be arranged in any direction, thereby enabling multiple sensor layers (7) to track the trajectory of each object continuously. Each conduit (6) is considered as one channel for grading objects; therefore the grading machine provides grading through multiple channels due to the presence of multiple conduits (6) in the grading machine, the grading machine is multi-channeled for speedy and effective grading of maximum number of objects.

EXAMPLE

The grading machine is worked upon, many different objects effectively by providing multiple grades in a single pass. To name few objects as follows:

Cashew Splits are graded effectively into multiple grades like JH, S, K, LWP, SWP, SPS etc. which cannot be separated by sieve.

Cardamoms are graded effectively into multiple grades like AGEB, AGB, AGS, AGS-1, AGS-2 etc.

Figure 2:
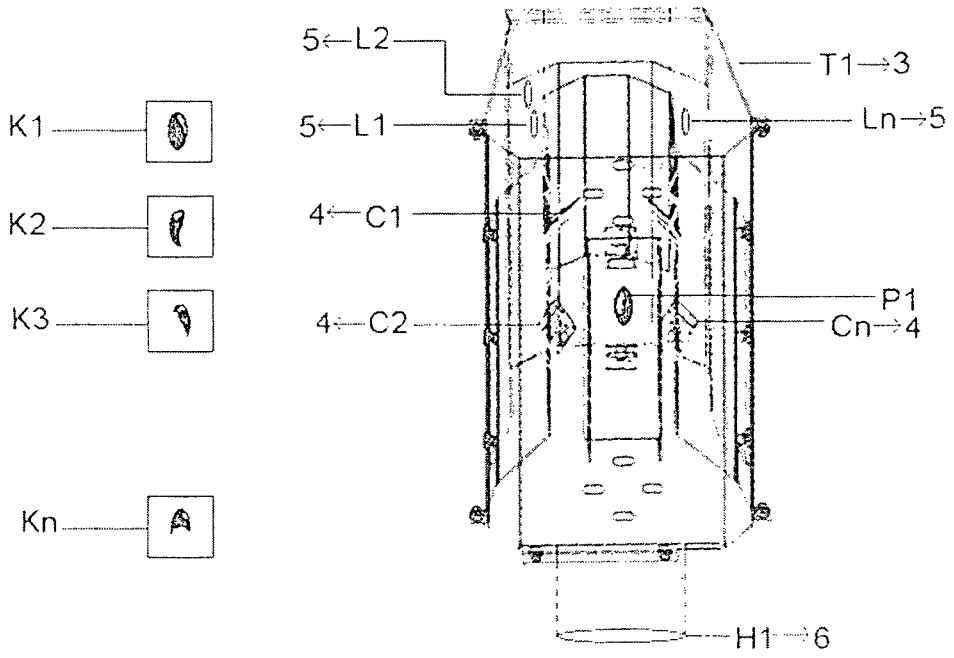
FIG. 2 is an isometric view of a single optics unit of the grading machine according to one embodiment of the invention.

Referring to FIG. 2, it is an isometric view of a single optics unit of the grading machine according to one embodiment of the invention. FIG. 2 is an enlarged view of only one optics unit T1 (3) out of multiple optics units (3) illustrated in FIG. 1. FIG. 2 illustrates the optics unit T1 (3) placed at the starting point of conduit H1 (6) which analyzes the object denoted as (P1). As illustrated the optics unit (T1) comprises of multiple cameras (4) indicated as C1, C2, . . . Cn (where 'n' is a natural positive integer) and multiple light sources (5) shown as L1, L2, . . . Ln (where 'n' is a natural positive integer). Multiple cameras (4) view each object from multiple sides or multiple angles to analyze external characteristics of the objects and capture at least six directional view of each object to analyze each object three dimensionally (3D) using correlation between multiple cameras which gives the information about different external characteristics of object (P1) in the conduit (H1). Multiple light sources (5) of the optics unit (T1) are positioned in the optics unit (3) in such that there is even brightness on the object (P1). Multiple light sources (3) illuminate the object (P1) from different angles to facilitate multiple cameras (4) to view the object clearly in a more enhanced way to analyze all external characteristics of the object (P1) in more enhanced manner, thereby increasing efficiency of multiple cameras (4) for deciding the accurate grade of the analyzed object (P1). Multiple cameras (4) capture different images which are shown as K1, K2 . . . Kn (where 'n' is a natural positive integer).

Figure 3:
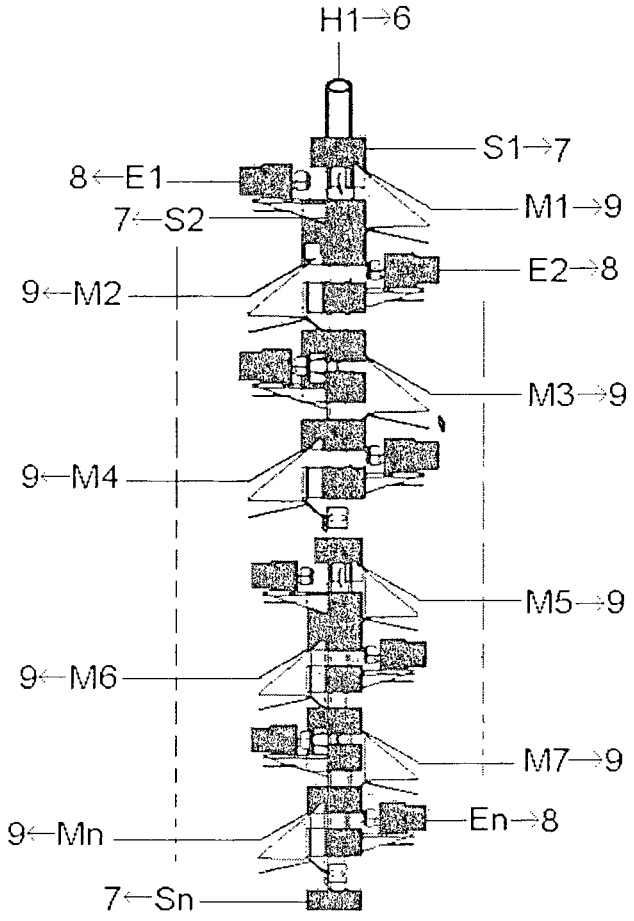
FIG. 3 is a front view of a single conduit illustrating arrangement of multiple sensor layers, arrays of multiple ejectors and multiple collecting chutes throughout the conduit according to one embodiment of the invention.

Referring to FIG. 3, it is a front view of a single conduit illustrating arrangement of multiple sensor layers and arrays of multiple ejectors and multiple collecting chutes throughout the conduit according to one embodiment of the invention. FIG. 3 is an enlarged view of only conduit H1 (6) out of multiple conduits illustrated in FIG. 1. Each conduit (6) of the grading machine is considered as one channel for grading objects. The conduit (6) can be a vertical rube (free fall) with gravity as conveyance or a slant surface or a horizontal surface or conveying opposite to gravity and the conduit (6) can be arranged in any direction to enable multiple sensor layers (7) to track the trajectory of each object continuously. The conduit (6) as illustrated in FIG. 3 is a tube into which objects conveys with 'gravity as conveyance' for purposes of illustration of conduit (6) in the grading machine which does not limit the variations in form and arrangement of conduits possible in the grading machine. Objects flow from optics unit into the conduit (H1). The conduit (H1) comprises of one sensor network which comprises of multiple sensor layers (7) shown as S1, S2, . . . Sn, which are arranged throughout the conduit (6), multiple sensor layer controllers (where 'n' is a natural positive integer) and at least one network controller to control all sensor layer controllers of one conduit (6). These sensor layers (7) are arranged from starting point of the conduit (H1) till the last dropping point. There are multiple collecting chutes (9) shown as M1, M2, M3, M4, M5M6, M7, . . . Mn (where 'n' is a natural positive integer) through which objects flow and gets collected into multiple collecting locations. The arrangement of multiple sensor layers (7) is such that, the object can be traced even if it is passed from any corner of the conduit (H1) to enable corresponding multiple sensor layer controllers to know the accurate position, velocity etc. of each conveying object which further helps master controller through the network controller of sensor network to predict the position, velocity etc. of conveying object in the conduit (HH1) and accordingly master controller signals to corresponding single-angled or multi-angled ejectors of different arrays of multiple ejectors (8) shown as E1, E2, . . . En (where 'n' is a natural positive integer) of corresponding conduit, and these ejectors eject each analyzed object in corresponding desired collecting location through multiple collecting chutes (9).

Figure 4:
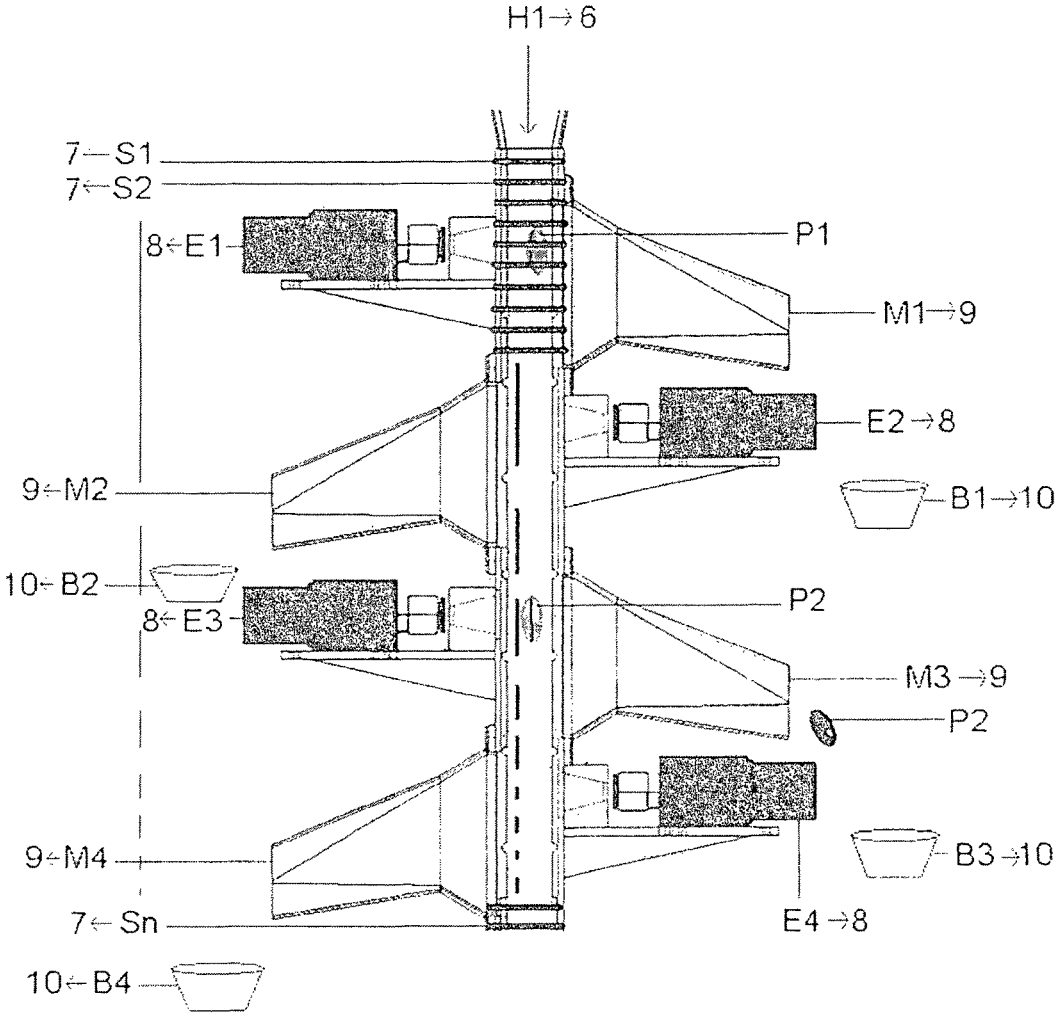
FIG. 4 is a front view of a single conduit illustrating the conduit as a tube with gravity as conveyance according to one embodiment of the invention.

Referring to FIG. 4, it is a front view of a single conduit illustrating the conduit as a tube with gravity as conveyance according to one embodiment of the invention. Only conduit H1 (6) is shown in FIG. 4, out of multiple conduits shown in FIG. 1. FIG. 4 details out the entire mechanism of continuous tracking of conveying object in single conduit (H1) and the entire mechanism of multiple grading in single conduit (H1). Objects P1, P2, P3 . . . Pn (where 'n' is a natural positive integer) of different external characteristics are conveyed from optics unit (T1) into the conduit (H1) comprising of multiple sensor layers which are divided into multiple layers (7) S1, S2, S3 . . . Sn (where 'n' is a natural positive integer) throughout the conduit (H1). As illustrated in FIG. 4, the distance between two sensor layers (S1, S2, . . . Sn) can be varied. Once, the object (P1) has passed from optics unit (T1), the master controller knows its grade and grading point. To know the position, velocity etc. of object (P1) the master controller continuously receives the information from network controller of sensor network, which collects the information from all/different sensor layer controllers of single conduit (H1).

Consider sensor layer S1, when the object (P1) passes from this layer, it cuts multiple rays, hence S1 provides information about object's position to S1 controller. S1 controller transfers this information to S2 controller and when actually the object (P1) moves to sensor layer S2, it cuts the rays and S2 provides the same information about object's position, velocity etc. to S2 controller. Simultaneously, while conveying the object (P1) from S1 to S2, the information about position, velocity etc. of object (P1) from these S1 controller and S2 controller is sent to the master controller through network controller and to S3 controller. Further, when the object (P1) cuts the sensor layer S3, S3 provides the information about object's position, velocity etc. to S4 controller and to the master controller through network controller and the process of tracking object by multiple sensor layers continues so on, thereby helping the master controller to know the accurate position, velocity etc. of the object (P1). The master controller interprets this data to decide the exact grading point of the object (P1) for signaling corresponding ejector of the conduit (H1) to eject the object (P1).

As shown in FIG. 4, object (P1) when reaches to its grading point, it can be ejected to its respective ejector which can be any ejector E1 or E2 or E3 or E4 (8) from its conveying path to its respective collecting location which can be B1, B2, B3 or B4 (10) through corresponding collecting chutes M1, M2, M3 or M4 (9). In FIG. 4, object (P2) is shown to be ejected by Ejector E3 (8) to eject by expelling a pre-defined duration of a jet of high pressure air or high pressure fluid towards the direction of conveying object (P2) which drops in collecting location B3 (10) through collecting chute M3 (9). If any object do not belong to any of the grades in a conduit (H1), it gets collected in the last collecting location which is attached to the corresponding conduit (H1).

Figure 5:
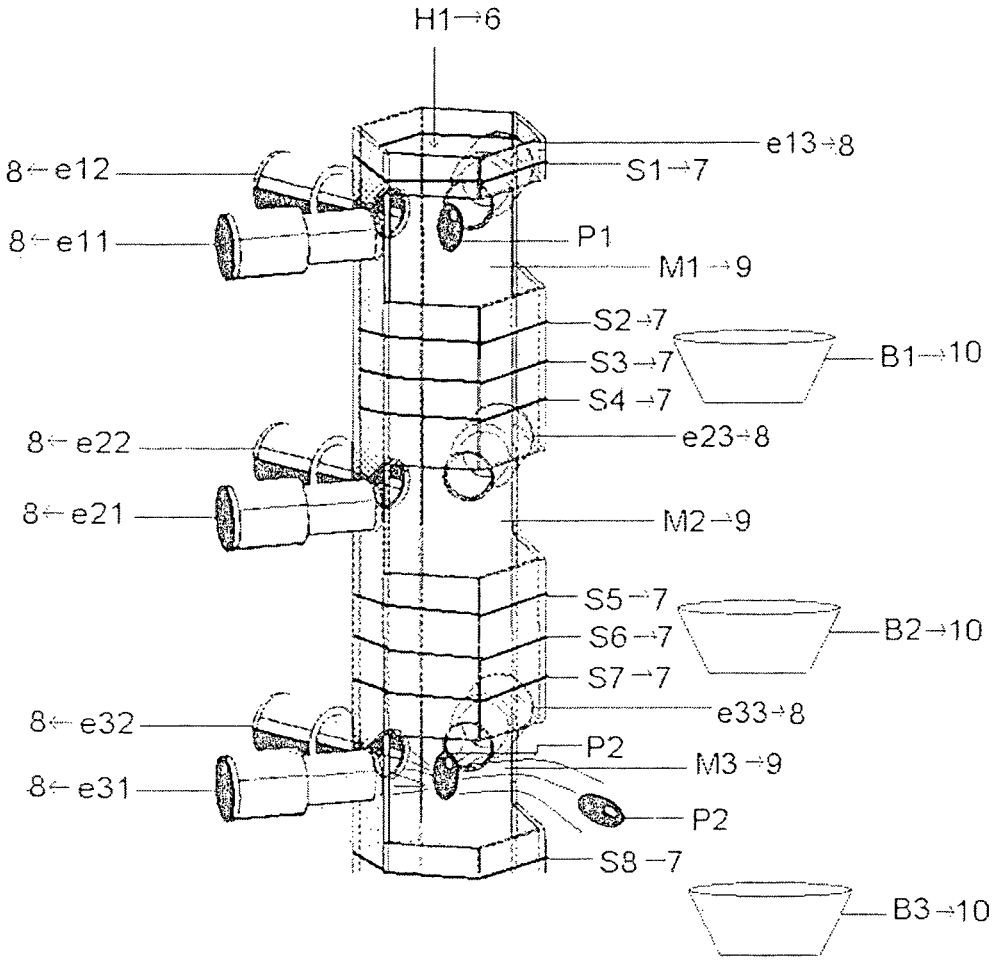
FIG. 5 is an isometric view of a conduit illustrating ejection of the conveying object by an array of single-angled or multiple angle based ejectors into common collecting location at each grade throughout the conduit according to one embodiment of the invention.

Referring to FIG. 5; it is an isometric view of a conduit illustrating ejection of the conveying object by an array of single-angled or multiple angle based ejectors into common collecting location at each grade throughout the conduit according to one embodiment of the invention. As shown in FIG. 5, at each grading point there are multiple ejectors (8) as shown e11,e12, e13 . . . e21, e22, e23 . . . e31, e32, e33 . . . which may extend to . . . enn located at different angles at same level in the conduit (H1) arranged with multiple sensor layers (7) as shown S1, S2 . . . S8 . . . which may extend to Sn. The arrangement of multiple single-angled or multi-angled ejectors may vary within the scope of the invention and the illustrated arrangement of said ejectors is only exemplary in nature without limiting the invention. Single-angled or multi-angled ejectors are appropriately used as per requirement. These types of ejectors will be used for predictable ejection, hence making the grading machine more efficient. The grading machine may also comprise of customized manifold for easy ejection of object.

Multiple sensor layers and said ejectors which may be arranged in different ways in the conduit (H1). When objects P1, P2, P3 . . . which may extend to Pn conveyed from optics unit into the conduit (H1) which is attached with multiple collecting chutes M1, M2, M3 . . . which may extend to Mn (where 'n' is a natural positive integer) through which objects flow at each grading point throughout the conduit (H1) and when object reaches to its accurate grading point in the conduit (H1), the corresponding object (P2) is shown to be ejected by multiple multi-angled ejectors (e31, e32, e33 . . . e3*n*) which are all activated at once by the master controller to effectively expel a jet of pre-defined duration of high pressure air or high pressure fluid to eject the object (P2) which drops in collecting location B3 (10) through collecting chute M3 (9). If any object do not belong to any of the grades in a conduit (H1), it gets collected in the last collecting location attached to conduit (H1). Due to this unique arrangement of multiple single-angled or multi-angled ejectors (e11, e12, . . . enn), even if the object passes from any corner of the conduit, it accurately falls into the desired common collecting location (B1, B2, B3, . . . which may extend to . . . Bn), thereby making the machine more efficient.

Figure 6:
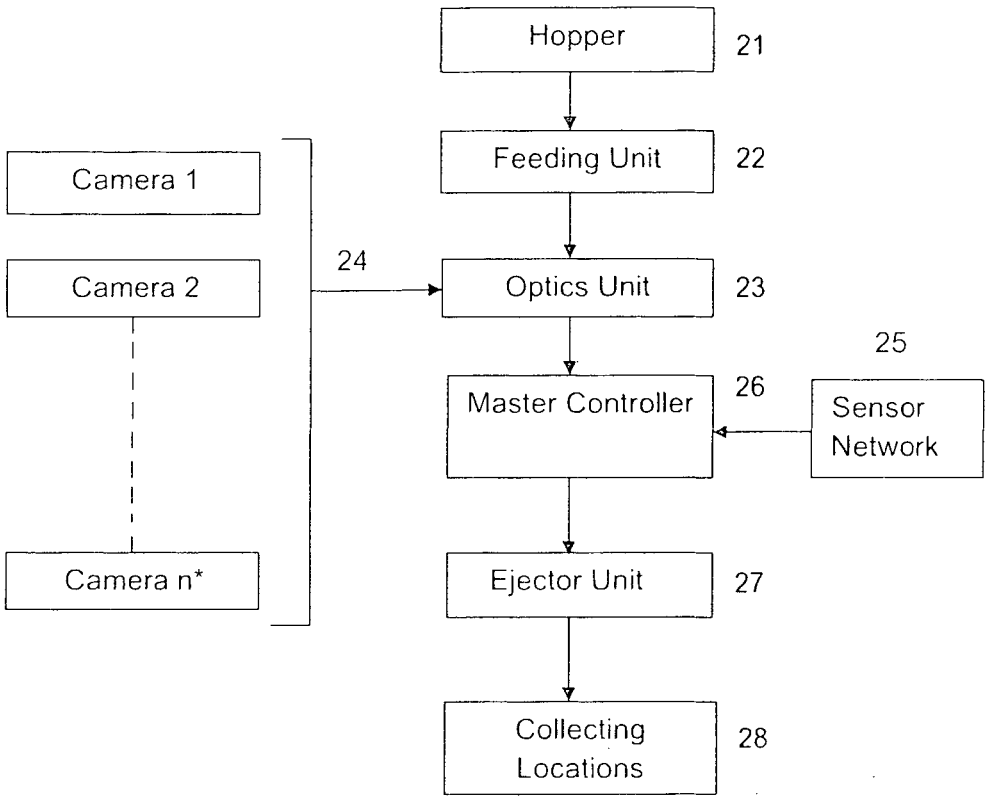
FIG. 6 is a block diagram illustrating different non-limiting steps involved in a novel process for grading objects into multiple grades in s single pass by continuously tracking the trajectory of objects based on external characteristics according to another embodiment of the invention.

According to another embodiment of the present invention, referring to FIG. 6, it is a block diagram illustrating different non-limiting steps involved in a novel process for grading objects into multiple grades in a single pass by continuously tracking the trajectory of objects based on external characteristics viz. viz. size, shape, color, texture, surface properties or any other possible external characteristics using the novel, intelligent and multi-channeled grading machine with trajectory tracking sensor network.

The novel process for grading objects is provided with the grading machine, which comprises of at least one hopper (21); at least one feeding unit (22) comprising of multiple feeders and multiple feed controllers; multiple optics units (23), wherein each optics unit (23) comprises multiple cameras (24), and multiple light source; multiple conduits; multiple sensor networks (25) in multiple conduits, wherein each conduit comprises of single sensor network comprising of multiple sensor layers, multiple sensor layer controllers and at least one network controller; at least one master controller (26): at least one ejector unit (27) comprising of arrays of single-angled or multiple angle ejectors in each conduit; multiple collecting chutes; and multiple collecting locations (28). The machine further comprises of vacuum creators placed respectively opposite to each ejector of ejector unit (27) throughout each conduit for predictable exit of the object into particular collecting grading location (28).

The objects flow from the hopper (21) into the feeding unit (22). The feeding unit (22) is automated and the rate of feeding of the objects in the feeding unit (22) is controlled by multiple feed controllers in a systematic way to avoid bulk flow of objects from feeding unit (22). The objects are released from the feeding unit (22) into multiple optics units (23). Multiple optics units (23) are further connected to multiple corresponding conduits. Objects flow from the feeding unit (22) into multiple optics units (23). In each optics unit (23) when any object enters, each object is viewed from multiple sides or multiple angles and images of each object are captured from at least six directional views by multiple programmable cameras (24) shown as camera 1, camera 2, camera n*, (wherein 'n*' denotes nth camera, where "n" is a natural positive integer), to analyze each object three dimensionally (3D) using correlation between cameras which gives the information about different external characteristics. Multiple light sources of the optics unit (23) enhances features of each object by illuminating each object to enable cameras (24) to analyze each object in a more enhanced manner. Cameras (24) along with light sources (Not shown in FIG. 2) of each optics unit (23) decide the exact grade of the analyzed objects by processing captured data. This is how each such optics unit (23) processes the captured data and decides different exact grades of each object.

Each optics unit (23) communicate signals related to exact grade of each analyzed object to the master controller (26) and the master controller (26) further decides the exact, accurate, final grade of each analyzed object based on input signals provided by each optics unit (23) and the master controller remembers intelligently final grade of each object present in optics unit (23). As each optics unit (23) is connected further to corresponding conduit; objects flow from each optics unit (23) into corresponding conduits. Each conduit is considered as one separate channel for grading objects, thereby facilitating multi-channeled grading of objects. The objects are released from multiple optics units (23) in to corresponding multiple conduits, wherein each conduit comprises single sensor network (25), arrays of multiple ejectors and multiple vacuum creators. As the grading machine comprises at least one ejector unit, it comprises arrays of multiple ejectors in each conduit of the grading machine. Each sensor network (25) comprises of multiple sensor layers arranged throughout each conduit, multiple sensor layer controllers and at least one network controller. As objects are conveyed through each conduit, multiple sensor layers in co-ordination with corresponding sensor layer controllers continuously track the position, velocity etc. of each object in its trajectory in real time, wherein these multiple sensor layers trigger signals to corresponding sensor layer controller about the position, velocity etc. of each falling object in the corresponding conduit in real time.

Further each sensor layer controller of corresponding conduit is coupled to the network controller of sensor network (25), network controller collects information from all the sensor layer controllers and further provides these signals to master controller (26) related to exact position, velocity etc. of each grade of conveying object accurately in real time, therefore these signals from each sensor layer controller from each conduit are communicated to the master controller (26) through the network controller of sensor network (25) of each conduit as the object cuts the multiple rays of corresponding sensor layers, so that the master controller (26) can decide the exact position, velocity etc. of each grade of conveying object accurately in real time by deciding grading point of each conveying object.

The master controller (26) decides the accurate final grade of each analyzed object based on signals received from the optics unit (3) related to external characteristics of objects and the master controller (26) can also anticipate the exact position, velocity etc. of each grade of object before the arrival of grading point of each object during its trajectory in corresponding conduit based on signals received from network controller of corresponding sensor network (25) of each corresponding conduit related to the exact position, velocity etc. of each grade of object accurately in real time. Based on these aforementioned two different signals received by the master controller, the master controller (26) sends signals to corresponding/particular single-angled ejectors or multiple angled ejectors of particular array of multiple ejectors of ejector unit (27), wherein these ejectors are located at same level near each grading point in corresponding conduit. In each corresponding conduit, at each grading point, single-angled or multi-angled ejectors along with vacuum creators and at least one collecting chute along with corresponding collecting location is located, wherein said vacuum creators are placed respectively opposite to each ejector throughout each conduit for easy grading by generating vacuum at each of the collecting chute based on the signals communicated by at least one sensor layer controller through network controller of corresponding conduit.

The master controller sends signals to multiple ejectors (of each conduit) of the ejector unit (27) for ejecting a jet of a pre-defined duration of high pressure air or high pressure fluid towards the conveying object in corresponding conduit when corresponding grade of object reached its grading point in corresponding conduit, as each ejector of corresponding conduit is coupled to the master controller (26), therefore each ejector receives signals related to ejection of each object sent by the master controller (26) before the arrival of each grade of object in corresponding conduit. When the particular grade of object conveys near particular grading point in corresponding conduit across its trajectory at particular position in corresponding conduit, these single-angled or multi-angled ejectors of corresponding conduit opens a valve to eject a jet of pre-defined duration of high pressure air or high pressure fluid to eject the particular grade of object and the pressure applied by said ejectors eject each grade of object accurately, thereby making each grade of object to fall into the corresponding desired collecting location (28) through corresponding collecting chutes for collecting different grades of objects into multiple grades in a single pass.

As will be readily apparent to those skilled in the art, the present invention may easily be produced in other specific forms without departing from its essential characteristics. The present embodiments are, therefore, to be considered as merely illustrative and not restrictive, the scope of the invention being indicated by the claims rather than the foregoing description, and all changes which come within therefore intended to be embraced therein.

What is claimed is:

1. A multi-channeled grading machine with trajectory tracking sensor network for grading objects into multiple grades in a single pass based on external characteristics by continuously tracking the trajectory of objects having size in the range of at least 2 mm to at least 35 mm, wherein the grading machine comprises:

at least one feeding unit located below a hopper to receive objects from said hopper, wherein said feeding unit comprises multiple feeders and multiple feed controllers, and wherein said feeding unit is automated and is operated and controlled by said feed controllers to control rate of feeding of said objects in a systematic way to release said objects further from each feeder downwards;

multiple optics units which are connected at lower side of said multiple feeders to receive said objects released from said multiple corresponding feeders, wherein at least one feeder is attached to at least one optics unit, and wherein at least one feed controller of one feeder controls the rate of feeding of said objects for further processing, and further wherein each optics unit comprises multiple programmable cameras and multiple light sources, and still further wherein said cameras are correlated to each other to view each object from multiple sides and/or multiple angles to capture at least six directional images of each object to analyze each object three-dimensionally (3D) based on data of captured images based on different external characteristics of each object and said multiple light sources enhances features of each object by illuminating each object to enable said cameras to analyze objects in a more enhanced manner which leads said cameras to decide the exact grade of each analyzed object, and wherein each of said optics unit processes the captured data by said cameras to decide exact grades of each of said object and further signals related to exact grade of each analyzed object are sent from each of said optics unit for further processing;

multiple conduits which are connected to the lower side of the corresponding multiple optics units to receive objects from said multiple optics unit, wherein at least one optics unit is connected at the top of starting point of each corresponding conduit to receive objects from corresponding optics unit, and wherein each conduit comprises a single network of multiple sensor layers which are lined up throughout each of said conduit from the starting point of each conduit till the last dropping point of objects; multiple sensor layer controllers to coordinate with the corresponding multiple sensor layers, wherein there is a single sensor layer controller to coordinate with the respective sensor layer of corresponding conduit; and at least one network controller for controlling all the sensor layer controllers of corresponding conduit, wherein each sensor layer comprises multiple sensors and each of said sensor layer continuously tracks the position of each object in trajectory in real time and trigger signals to said corresponding sensor layer controller about the position, velocity of each conveying object in real time; and further wherein each sensor layer of the corresponding conduit triggers signals about at least the position and velocity to said network controller which receives said signals from all the sensor layer controllers of the corresponding conduit and further said network controller of the corresponding conduit sends said signals from all sensor layer controllers of the corresponding conduit for further processing;

at least one master controller which is coupled to each optics unit, each network controller of each sensor network to coordinate different signals from each of said optics units and each of said network controller of each sensor network of the grading machine as said master controller receives said signals related to grade of each analyzed object sent by each of said optics unit and decides the exact, accurate, final grade of each of said analyzed object, wherein said cameras of said optics unit are capable of correlation between them by said master controller; and further said master controller also receives signals sent by each network controller of each of said sensor network of the corresponding conduit related to exact position and velocity of each grade of conveying object accurately in real time, as the object cuts the multiple rays of corresponding said sensor layers, thereby anticipating the exact position, velocity of each conveying object during trajectory thereof in the corresponding conduit by deciding a grading point thereof and further said master controller sends signals related to ejection of said conveying objects in the corresponding conduit when said conveying object reaches to the grading point in the corresponding conduit;

at least one ejector unit comprising arrays of multiple ejectors in combination with multiple vacuum creators and said ejectors and said vacuum creators are located in each conduit in addition to said sensor network, wherein said ejectors are single-angled ejectors or multi-angled ejectors in each of said conduit, wherein said ejectors are located at same level near each grading point in the corresponding conduit and further when said conveying object reaches to the grading point, said signals related to ejection of said conveying objects from said master controller are received by the corresponding ejector of said corresponding conduit, thereby ejecting a jet of predefined duration of high pressure air or high pressure fluid directed towards said conveying object across the trajectory at the grading point in the corresponding conduit and ejecting the corresponding multiple grades of objects from a conveying path in the corresponding conduit, and wherein said at least one vacuum creator is located respectively opposite to each of the corresponding ejector throughout each of said conduit for predictable exit or ejection of said conveying object from said corresponding conduit;

multiple collecting chutes to convey said corresponding multiple grades of objects from said corresponding conduit ejected by said ejectors in cooperation with said vacuum creators for collecting purpose, wherein said vacuum creators generate vacuum at each of said collecting chute based on the signals communicated by at least one sensor layer controller through the network controller of the sensor network of the corresponding conduit; and multiple collecting locations for collecting said corresponding multiple grades of objects into multiple grades in a single pass.

2. The grading machine of claim 1, wherein each of said feed controller of the corresponding feeder is also coupled to said master controller to control rate of flow of objects into said corresponding optics unit and further from said optics unit into the corresponding conduit based on the need of number of objects to be fallen in particular conduit as said master controller is coupled to the sensor network to receive signals related to rate of flow of objects in said corresponding conduit and after receiving signals from said master controller, said feed controller of the corresponding feeder releases controlled number of objects in corresponding optics unit and said corresponding conduit as per the need for effective grading.

3. The grading machine of claim 1, wherein each of said conduit is either a vertical tube with gravity as conveyance or a slant surface or a horizontal surface or conveying opposite to gravity, and wherein each said corresponding conduit is arranged in any direction, thereby enabling said one or multiple sensor layers of the corresponding conduit to track the trajectory of each said conveying object continuously, and further wherein each said sensor layer is connected to single sensor layer controller of the corresponding conduit, and still further wherein said all sensor layer controllers of the corresponding conduit are connected to the at least one network controller of the corresponding conduit which receives signals related to at least position and velocity of said conveying object from said all sensor layer controllers of the corresponding conduit, thereby the trajectory of said conveying object is tracked continuously in real time, and wherein said network controller of the sensor network of the corresponding conduit sends said signals to said master controller for deciding the grading point of said conveying object, and said master controller decides the accurate grading point of each conveying object in real time.

4. The grading machine of claim 1, wherein said signals from each sensor layer of the corresponding conduit related to position and velocity of each said conveying object is analyzed by all sensor layer controllers of the corresponding conduit accurately in real time as all sensor layer controllers are always active during the grading process to receive said signals from said one or multiple sensor layers of the corresponding conduit to sense each grade of said conveying object which can randomly come across any sensor of the corresponding conduit.

5. The grading machine of claim 1, wherein when said any sensor layer of corresponding conduit sense any hollow or damaged conveying object in the corresponding conduit, to decide different properties including specific gravity and hollowness of said hollow or damaged conveying object intelligently by the network controller of the corresponding sensor network of the corresponding conduit depending on velocity variation of any of said hollow or damaged conveying object, and wherein said network controller of the sensor network signals related to said properties of said hollow or damaged conveying object to said master controller and further wherein said master controller further decides the accurate position and velocity of each of said hollow or damaged conveying object to reach to the grading point in real time.

6. The grading machine of claim 1, wherein at each of the grading point of the corresponding conduit, there exists at least single-angled ejectors or multi-angled ejectors; and at least one collecting chute along with the corresponding collecting location; and wherein said single-angled ejectors or multi-angled ejectors are installed in said grading machine according to properties including specific gravity and hollowness of said conveying objects to be graded, wherein said grading machine further comprises of customized manifold for easy ejection of differently sized said conveying objects.

7. The grading machine of claim 1, wherein said hopper, said feeding unit, said optics unit, said conduit or other parts of said machine are made from a group consisting of polyurethane, food grade acrylic, ionized elements and teflon coated material.

8. A process for grading objects into multiple grades in a single pass by continuously tracking the trajectory of objects based on external characteristics, wherein the process comprises the steps of:

providing the grading machine of claim 1;

feeding objects to be graded in said hopper;

conveying of objects from said hopper into said feeding unit, wherein said feeding unit is operated and controlled by said multiple feed controllers to control rate of feeding of said objects in a systematic way, wherein said feed controllers are coupled to said master controller for effective feeding as said feed controller receives signals from said network controller of said sensor network of the corresponding conduit through said master controller;

conveying of said objects from multiple feeders of said feeding unit into the corresponding multiple optics units, wherein viewing of said objects by said multiple programmable cameras of said optics unit from multiple sides and/or multiple angles and capturing images of said objects from at least six directional view and analyzing each object three dimensionally (3D) is carried out by said cameras which are correlated to each other along with multiple light sources of said optics unit and further processing of captured image data is carried out by said cameras of said optics unit to decide the exact grade of each analyzed object, thereby each of said optics unit decides the exact grade of each of said object;

sending signals related to the exact grade of each analyzed object by said optics unit to said master controller and receiving said signals from said optics unit by said master controller to decide the exact, accurate, final grade of each of said analyzed object based on signals provided by each of said optics unit;

flowing of objects from said each of said optics unit into the corresponding conduits as each of said conduit is considered as one separate channel for grading said objects, thereby facilitating multi-channeled grading of objects;

conveying of said objects from each of said optics units into the corresponding conduits, wherein each conduit comprises the single sensor network comprising said multiple sensor layers, said multiple sensor layer controllers, said at least one network controller and said conduit also comprises said arrays of multiple single-angled ejectors or said arrays of multi-angled ejectors, and wherein said multiple sensor layers of each of said conduit continuously track the position and velocity of each conveying object in the trajectory in real time, and trigger signals to said corresponding sensor layer controller about the position and velocity of each conveying object in real time;

receiving signals from each of said sensor layer controllers of the corresponding conduit related to the position and velocity of each conveying object in real time to determine the exact position and velocity of each conveying object accurately in real time in said corresponding conduit by said network controller of said sensor network of corresponding conduit;

sending said signals from said corresponding network controller of said sensor network to said master controller as each of said network controller of each conduit is coupled to said master controller;

receiving of said signals from said network controller of said sensor network of the corresponding conduit by said master controller and as said object cuts the multiple rays of the corresponding sensor layers, thereby anticipating the exact position and velocity of each of said conveying object accurately in real time before the arrival of grading point of each conveying object during the trajectory in the corresponding conduit by deciding the grading point of each said conveying object;

sending signals related to ejection of said conveying object by said master controller to said arrays of single-angled ejectors or said arrays of multi-angled ejectors of each of said corresponding conduit when each of said conveying object reaches at its the grading point for ejecting corresponding the multiple conveying objects from the corresponding conduit;

receiving signals from said master controller about exact position and velocity of each conveying object by said arrays of single-angled ejectors or said arrays of multi-angled ejectors;

opening a valve of the particular ejector of the corresponding conduit and directing the jet of the predefined duration of high pressure air or high pressure fluid towards each of said conveying object across the trajectory near the grading point in corresponding conduit when each of said conveying object reaches to the grading point in the corresponding conduit;

ejecting the particular accurate grade of each of said conveying object from said corresponding conduit, wherein said conveying object is ejected with assistance of said vacuum creators placed respectively opposite to each of said ejector throughout each conduit for easy grading, and further wherein said pressure of air or fluid vary according to said properties including specific gravity and hollowness of said conveying objects to be graded;

ejecting multiple accurate grades of said objects from said corresponding conduit by said ejectors and convey further through multiple collecting chutes; and collecting multiple grades of said objects in the multiple collecting chutes into multiple collecting locations in a single pass.

9. The process for grading objects of claim 8, wherein said step of ejecting said conveying objects is improved by adding customized manifolds at said ejector side or said vacuum creator at the collecting location, thereby providing refined grading location for said conveying objects.

* * * * *